US007654519B2

(12) United States Patent
Yamane et al.

(10) Patent No.: US 7,654,519 B2
(45) Date of Patent: Feb. 2, 2010

(54) IMAGE FORMING APPARATUS AND SHEET MATERIAL CONVEYANCE DEVICE USED THEREIN

(75) Inventors: Hideo Yamane, Hachioji (JP); Kazuo Sato, Hachioji (JP); Eiji Sugimoto, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 337 days.

(21) Appl. No.: 11/474,290

(22) Filed: Jun. 26, 2006

(65) Prior Publication Data

US 2007/0132174 A1 Jun. 14, 2007

(30) Foreign Application Priority Data

Dec. 13, 2005 (JP) ..... 2005-358716

(51) Int. Cl.
*B65H 29/70* (2006.01)

(52) U.S. Cl. ..... 271/188; 399/409; 162/197

(58) Field of Classification Search ..... 271/188; 399/409, 406; 162/197
See application file for complete search history.

(56) References Cited

U.S. PATENT DOCUMENTS 5,202,737 A * 4/1993 Hollar ..... 399/406
5,287,157 A * 2/1994 Miyazato et al. ..... 399/406
5,414,503 A * 5/1995 Siegel et al. ..... 399/406
6,199,859 B1 * 3/2001 Schauer et al. ..... 271/188
6,965,750 B2 * 11/2005 Muratani ..... 399/406

FOREIGN PATENT DOCUMENTS

| | | |
|---|---|---|
| EP | 0 807 862 A2 | 11/1997 |
| JP | 59-108641 | 6/1984 |
| JP | 6-156852 | 6/1994 |
| JP | 9-301599 | 11/1997 |
| JP | 10-114454 | 5/1998 |
| JP | 11-193160 | 7/1999 |
| JP | 2001-282031 | 10/2001 |

OTHER PUBLICATIONS

European Search Report.

* cited by examiner

*Primary Examiner*—David H Bollinger
(74) *Attorney, Agent, or Firm*—Finnegan, Henderson, Farabow, Garrett & Dunner, L.L.P.

(57) ABSTRACT

An image forming apparatus comprising: an image forming section which forms an image on a sheet material; a curl correcting mechanism which interposes and conveys the sheet material on which the image has been formed by the image forming section. Pressure applied to one surface of the sheet material during an interposing operation and a conveying speed of the sheet material can be changed, the curl correcting mechanism changes the conveying speed from an initial speed vs to a target speed vo higher than the initial speed (vo>vs) while the sheet material is pressed, and the curl correcting mechanism changes the pressure to a high pressure in response to a change of the conveying speed, whereby a curl of the sheet material is reduced.

9 Claims, 7 Drawing Sheets

FIG. 7 (A)
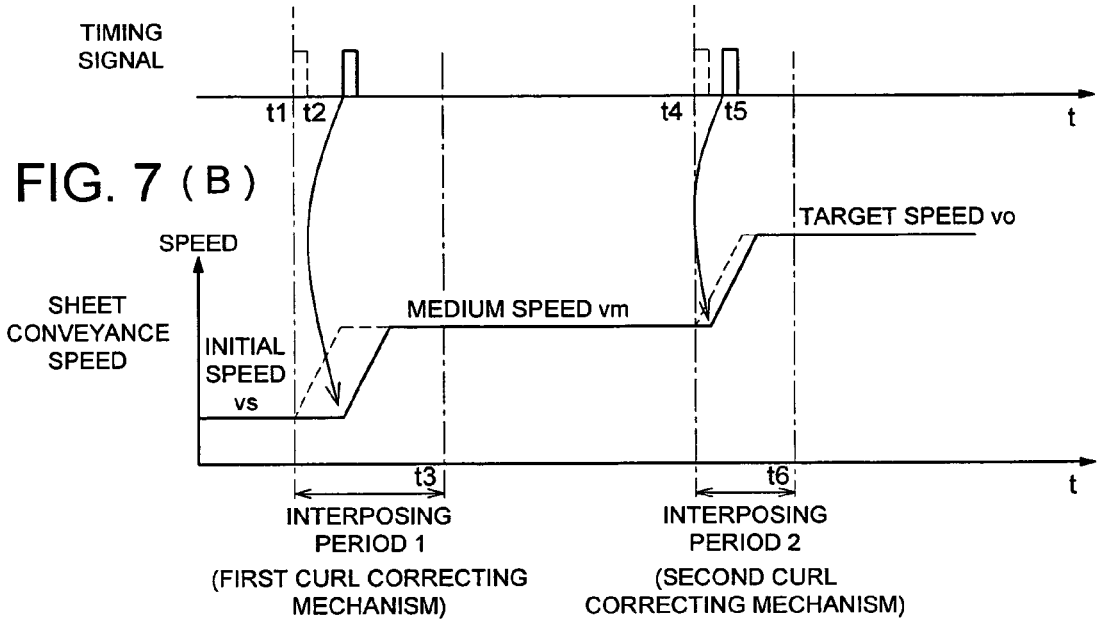
FIG. 7 (B)
FIG. 7 (C)
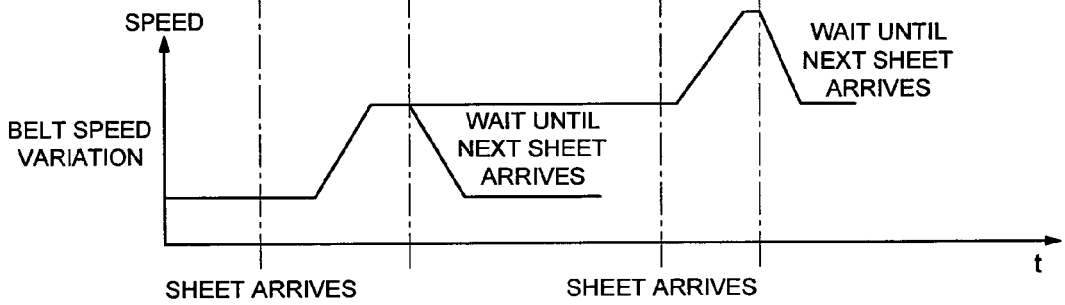
FIG. 7 (D)
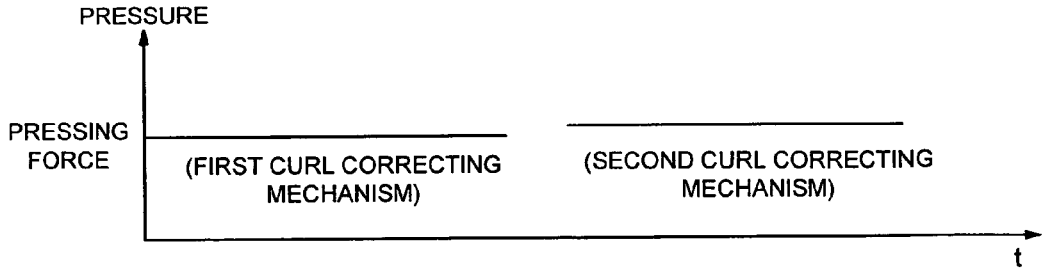

IMAGE FORMING APPARATUS AND SHEET MATERIAL CONVEYANCE DEVICE USED THEREIN

This application is based on Japanese Patent Application No. 2005-358716 filed on Dec. 13, 2005, which is incorporated hereinto by reference.

BACKGROUND OF THE INVENTION

The present invention relates to an image forming apparatus including a single machine function of a printer, a copying machine or facsimile machine, or multi-function thereof, an image forming method, and a sheet material conveyance device used therein, particularly to the art of improving the productivity by correcting the curl of the sheet material with an image formed thereon, and contributing to formation of great quantities of images by increasing the conveying speed.

When a sheet material on which an image has been formed passes through the fixing unit of an image forming apparatus, the sheet material will be curled during the passage through the fixing unit. One of the conventional ways of correcting the curl uses a curl correcting member, wherein the sheet material is conveyed by turning the belt with a conveying roller, and to pressing the sheet material conveyed by the belt in one direction using a rotatable pressing roller, whereby the sheet material is interposed and uncurled. If this procedure fails to correct the curl, the direction of conveyance is switched and the surface of the sheet material pressed by the pressing roller is changed. Then the sheet material is again passed through the curl correction device, whereby the sheet is uncurled (Patent Document 1, i.e., Official Gazette of Japanese Patent Tokkaihei 10-114454).

According to another conventional way of correcting the curl, a sheet material is interposed between a conveying member and a curling member during the conveyance wherein the ends of the sheet material are held. In this state, the conveyance speed of sheet material is reduced, and the sheet is uncurled (Patent Document 2, i.e., Official Gazette of Japanese Patent Tokkaihei 11-193160).

Separately from the aforementioned conventional art, it is required to increase the conveying speed and to improve productivity. When these requirements are to be met by the conventional image forming apparatus, it will be necessary to increase the conveying speed using a curl correcting mechanism and to install another conveyance mechanism on the downstream side thereof. When the art of the Patent Document 1, for example, is used to meet the former requirement, the sheet material is interposed (pressed). When this pressure has reached a predetermined level, the conveying speed is increased. This procedure allows a curl to remain on the trailing edge of the sheet material. To meet the latter requirement, the size of the apparatus has to be increased by the addition of another conveyance mechanism. These problems remain unsolved when the aforementioned requirements are to be met.

SUMMARY OF THE INVENTION

The object of the present invention is to provide the technology of reducing the curl and improving the productivity by ensuring that the conveying speed and the pressure for curl correction can be changed while a curl is corrected by a curl correcting mechanism.

The following structures are provided to achieve the aforementioned object.

(1) An image forming apparatus includes: an image forming section for forming an image on a sheet material; and a curl correcting mechanism for interposing and conveying the aforementioned sheet material on which an image is formed by the aforementioned image forming section, wherein the sheet material interposing pressure and conveying speed can be changed; wherein the curl correcting mechanism conveys the sheet material by changing the aforementioned conveying speed from the initial speed vs to the target speed vo (vo>vs) while the aforementioned sheet material is pressed, and changing the aforementioned pressure to a high pressure in response to the speed change, whereby the curl of the aforementioned sheet material is reduced.

(2) An image forming apparatus includes: an image forming section for forming an image on a sheet material; a curl correcting mechanism for interposing and conveying the aforementioned sheet material on which an image is formed by the aforementioned image forming section, wherein the pressure applied to one surface of the sheet material during the interposing operation and conveying speed can be changed; a timing detection section for detecting the timing when the sheet material with an image formed thereon is interposed by the aforementioned curl correcting mechanism, and for outputting the timing signal for changing the aforementioned conveying speed; and a controller for providing control in such a way that, upon receipt of the aforementioned timing signal, the aforementioned curl correcting mechanism changes the conveying speed from the initial speed vs to a higher speed as the target speed vo (vo>vs) and increases the aforementioned pressure in response to the new conveying speed.

(3) An image forming apparatus includes: an image forming section for forming an image on a sheet material; a first curl correcting mechanism for interposing and conveying the aforementioned sheet material on which an image is formed by the aforementioned image forming section, wherein the pressure applied to one surface of the sheet material and the conveying speed can be changed; and a second curl correcting mechanism, located downstream of the aforementioned first curl correcting mechanism, for interposing and conveying the aforementioned sheet material, wherein the pressure is applied to other surface opposite to the aforementioned one surface of the sheet material, and the conveying speed can be changed; wherein the aforementioned first curl correcting mechanism changes the aforementioned conveying speed from the initial speed vs to a higher speed as the medium speed vm (vm>vs) while pressing the sheet material; and the aforementioned second curl correcting mechanism changes the aforementioned conveying speed from the aforementioned medium speed vm to a higher speed as the target speed vo (vo>vm) while pressing the sheet material, whereby the curl of the aforementioned sheet material is reduced.

(4) An image forming apparatus includes: an image forming section for forming an image on a sheet material; a conveyance path for conveying the sheet material with an image formed thereon by the aforementioned image forming section, a first curl correcting mechanism, located on the aforementioned conveyance path, provided with a first belt conveying mechanism; and a first roller member for applying pressure to one side of the sheet material being conveyed, in the direction of engagement with the first belt of the aforementioned first belt conveying mechanism; wherein the conveying speed can be changed by driving either the aforementioned first belt conveying mechanism or the first roller member; a second the curl correcting mechanism which receives the sheet material outputted from the first curl correcting mechanism and is provided with a second belt conveying mechanism, and a second roller member for applying pressure to the side opposite to the aforementioned surface of the aforementioned sheet material being conveyed, in the direction of engagement with the second belt of the aforementioned second belt mechanism; wherein the conveying speed can be changed by driving either the aforementioned second belt conveying mechanism or the second roller member; a timing detection section for outputting the first timing signal showing the timing when the sheet material with an image formed thereon is interposed by the first belt and the first roller member, and the second timing signal showing the timing when the sheet material with an image formed thereon is interposed by the second belt and the second roller member; a first speed control section which, upon receipt of the first timing signal, controls the aforementioned first curl correcting mechanism to change the conveying speed from the initial speed vs to the medium speed vm (vm>vs); and a second speed control section which, upon receipt of the second timing signal, controls the second curl correcting mechanism to change the conveying speed from the aforementioned medium speed vm to target speed vo (vo>vm).

(5) An image forming apparatus includes: an image forming section for forming an image on a sheet material; a returning conveyance path for reversing the sheet material with an image formed on one surface thereof by the aforementioned image forming section, and for conveying it back to the aforementioned image forming section so as to print on the rear surface; a curl correcting mechanism on the returning side, located on the aforementioned returning conveyance path, for interposing and rotating the sheet material having an image formed on the aforementioned one surface, and for conveying it by applying a predetermined interposing pressure; a curl correcting mechanism which, upon receipt of the sheet material with images formed on both surfaces by the aforementioned image forming section, sandwiches, rotates and conveys the aforementioned sheet material, wherein pressure applied to the sheet material during an interposing operation and a conveying speed of the sheet material can be changed, and the curl correcting mechanism changes the aforementioned conveying speed from the initial speed vs to the target speed vo (vo>vs) while the aforementioned sheet material is pressed, and increases the pressure in conformity to the new speed, wherein the interposing pressure and the conveying speed can be changed.

(6) A sheet material conveying device includes: a conveyance mechanism for elastic interposing the sheet material with an image formed thereon; a roller member for pressing one surface of the aforementioned sheet material conveyed at the first speed against the aforementioned conveyance mechanism and interposing the sheet material, a curl correcting mechanism for driving the aforementioned conveyance mechanism or roller member in such a way that the conveying speed can be changed; wherein the aforementioned conveying speed is changed from the first speed to the second faster than the first speed while pressure is applied to the aforementioned sheet material, and the sheet material is conveyed.

BRIEF DESCRIPTION OF THE DRAWINGS

FIGS. 7(A) through (D) are the diagrams showing the operation timing of the sheet material conveying section 200 of FIG. 5.

DETAILED DESCRIPTION OF THE PREFERRED EMBODIMENT

Figure 1:
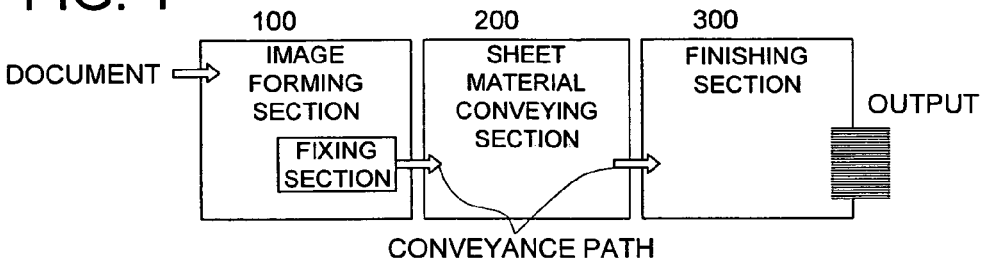
FIG. 1 is a diagram representing the functional structure of the image forming apparatus as a whole.
Figure 2:
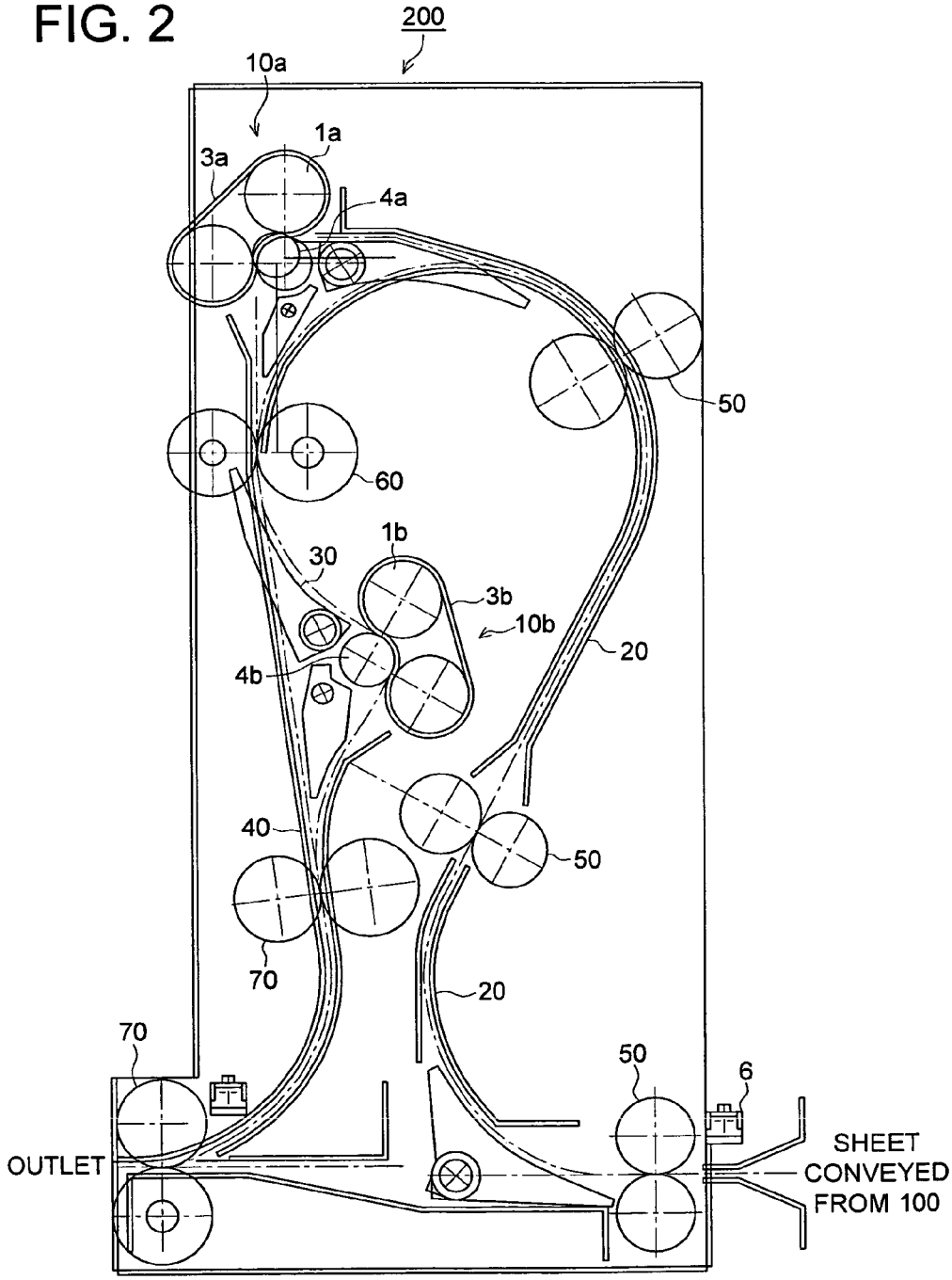
FIG. 2 is a diagram representing the layout of the mechanism of the sheet material conveying section (sheet material conveyance device) as embodiment of the present invention.
Figure 3:
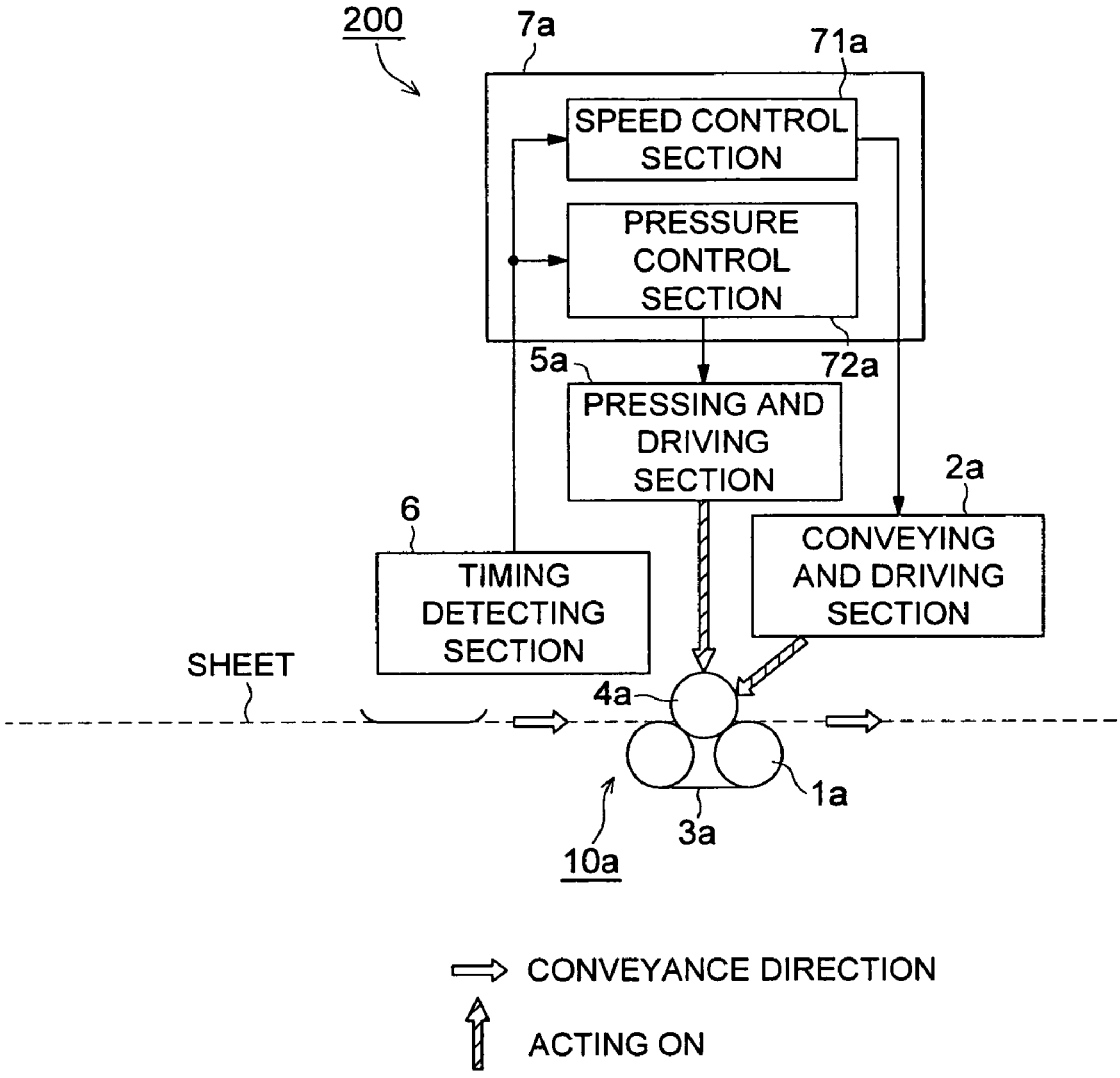
FIG. 3 is a functional structure of the first embodiment of the sheet material conveying section 200 according to the present invention.
Figure 4:
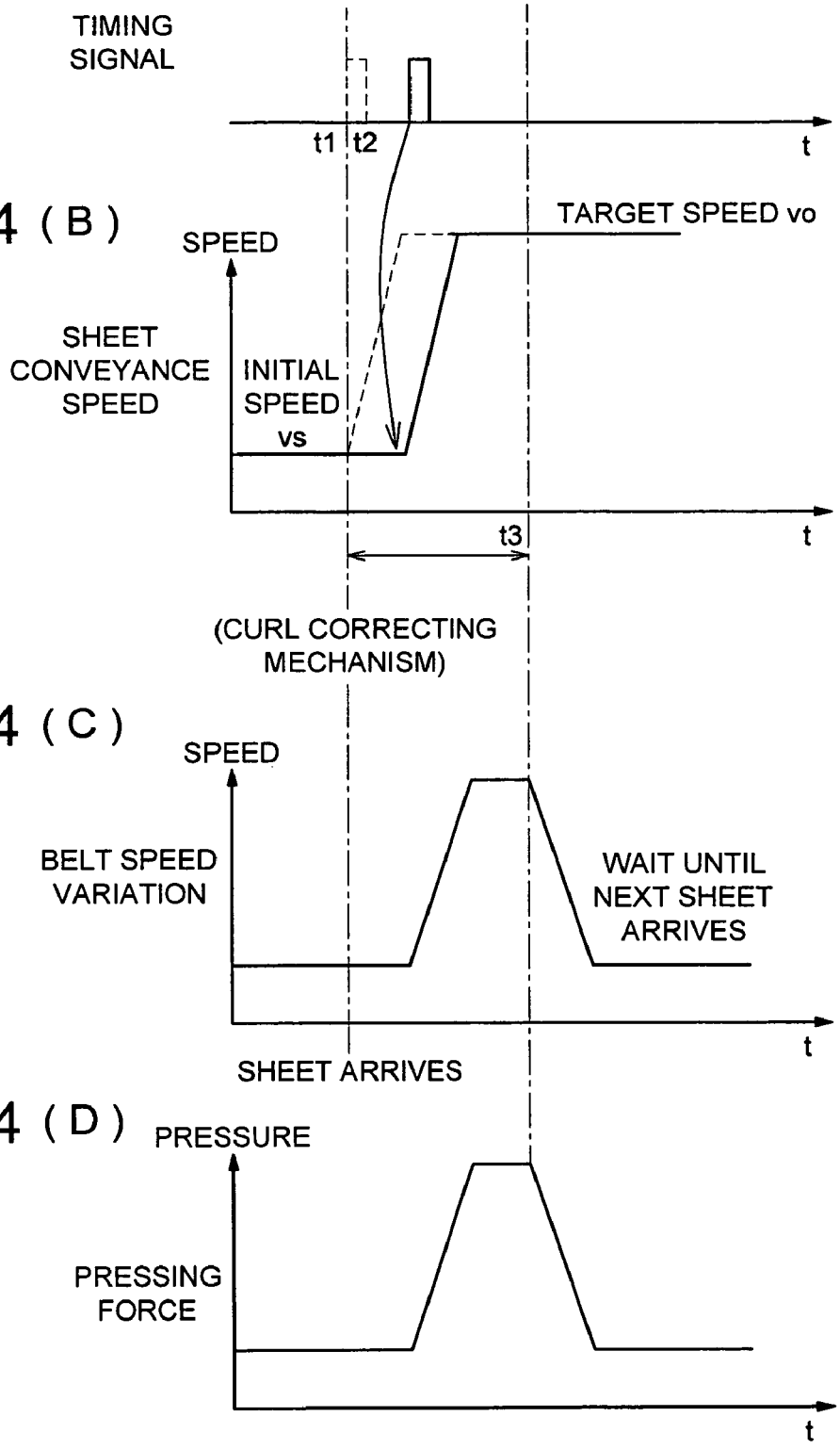
FIGS. 4(A) through (D) are the diagrams showing the operation timing of the sheet material conveying section 200 of FIG. 3.
Figure 5:
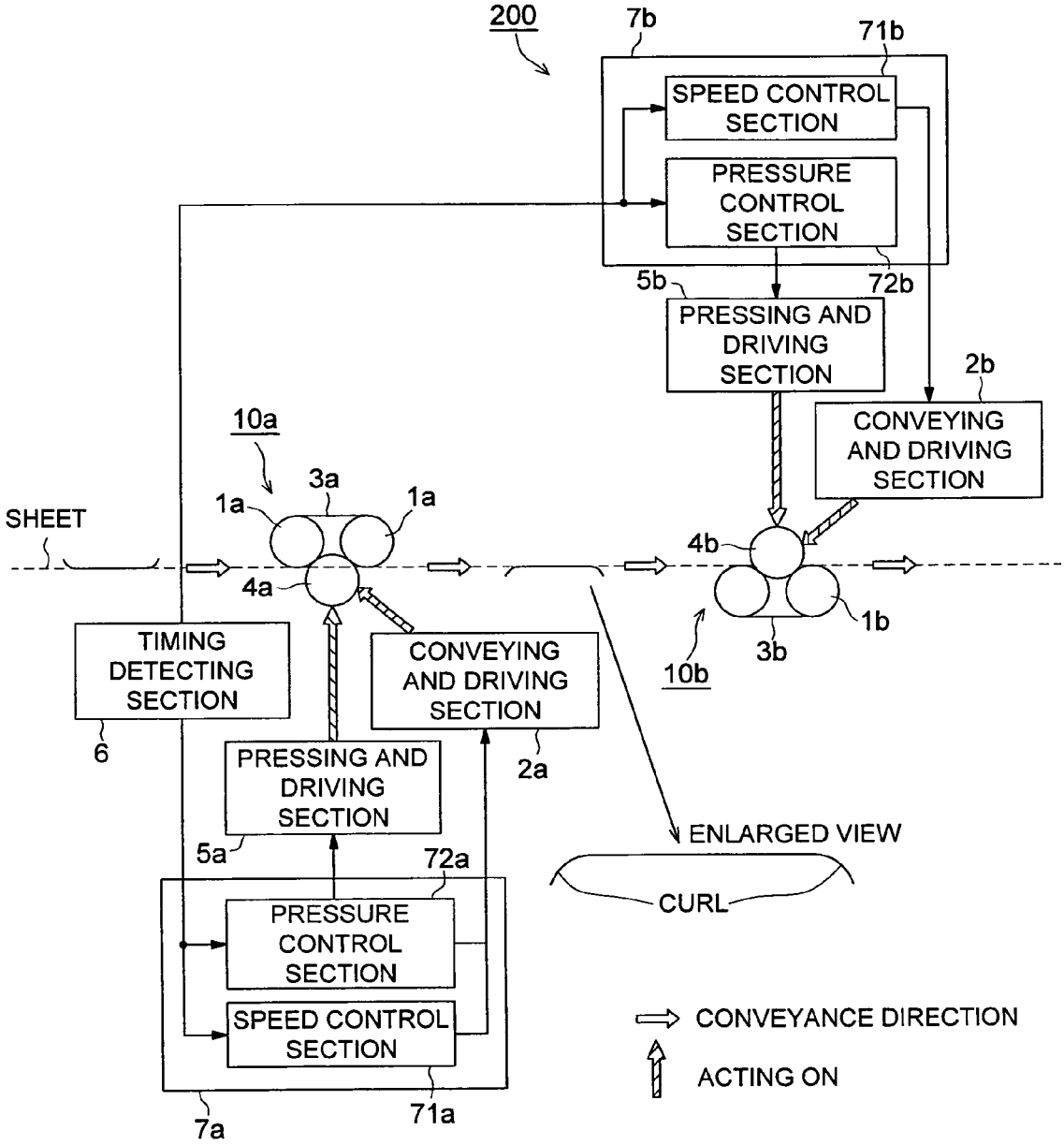
FIG. 5 is a functional structure of the second embodiment of the sheet material conveying section 200 according to the present invention.
Figure 6:
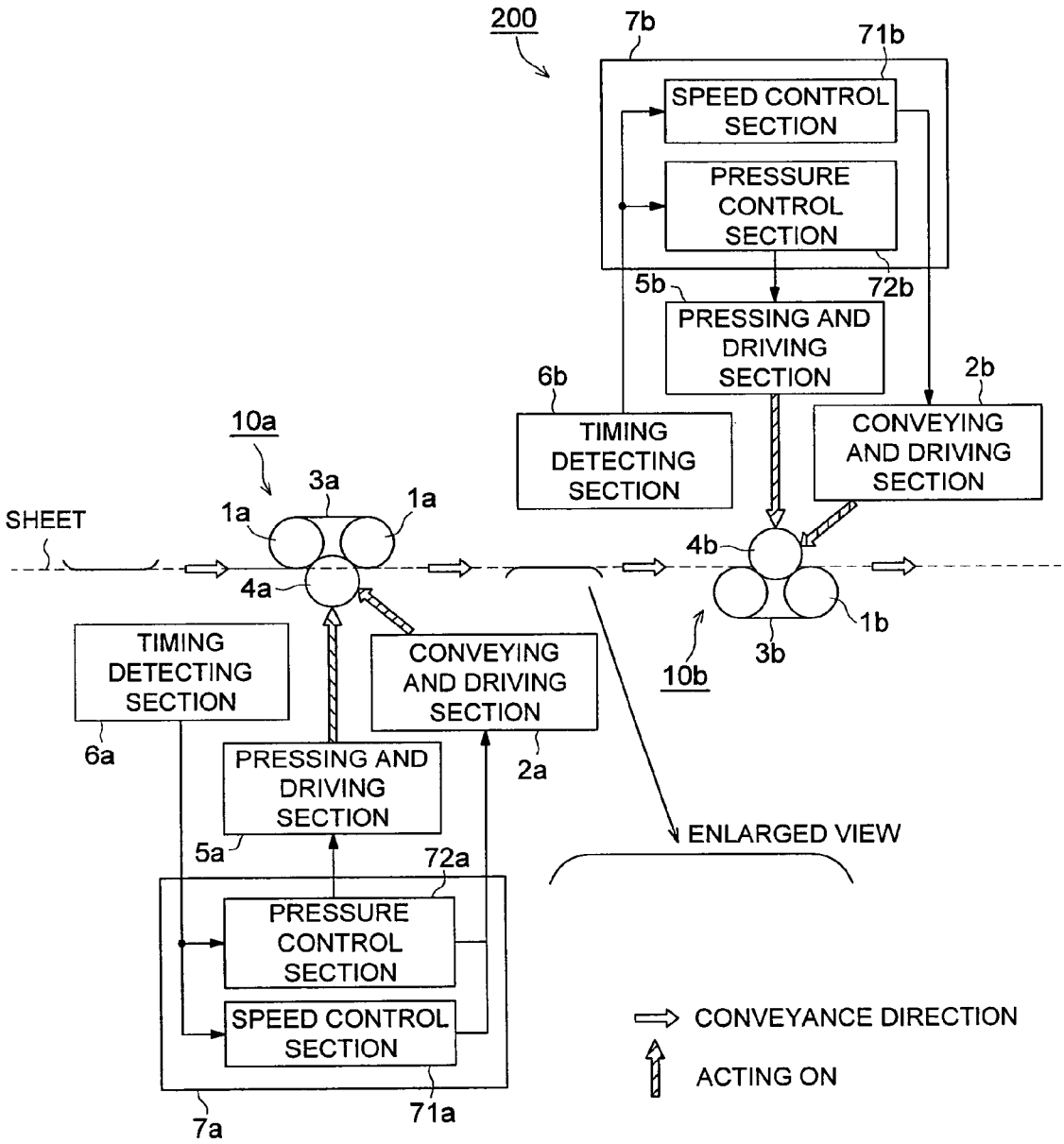
FIG. 6 is a variation of FIG. 5.
Figure 8:
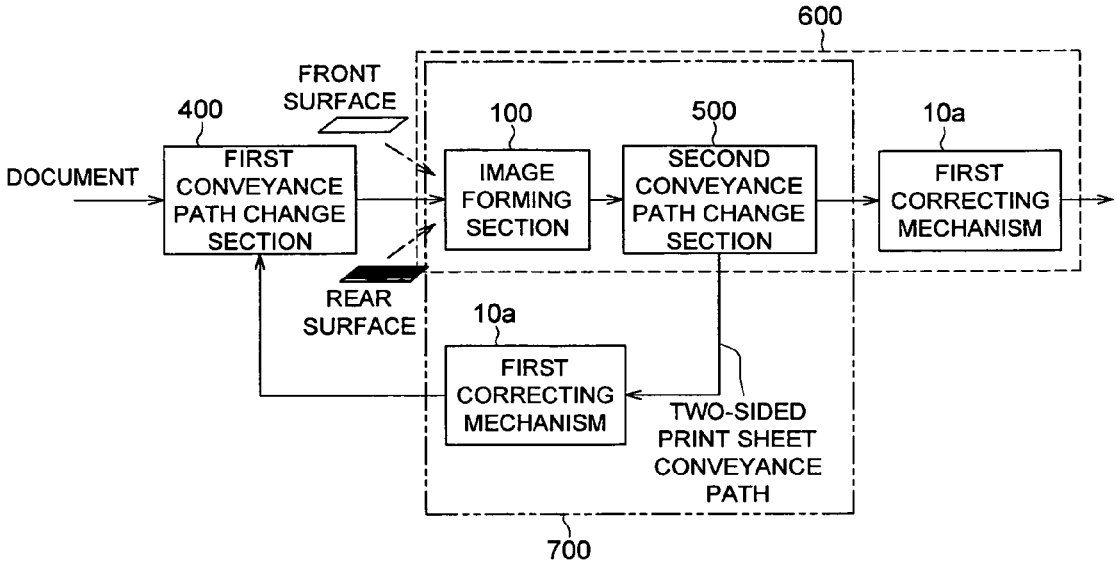
FIGS. 8(A) and (B) are the diagrams showing the applied example of the embodiment of FIG. 3.
Figure 8:
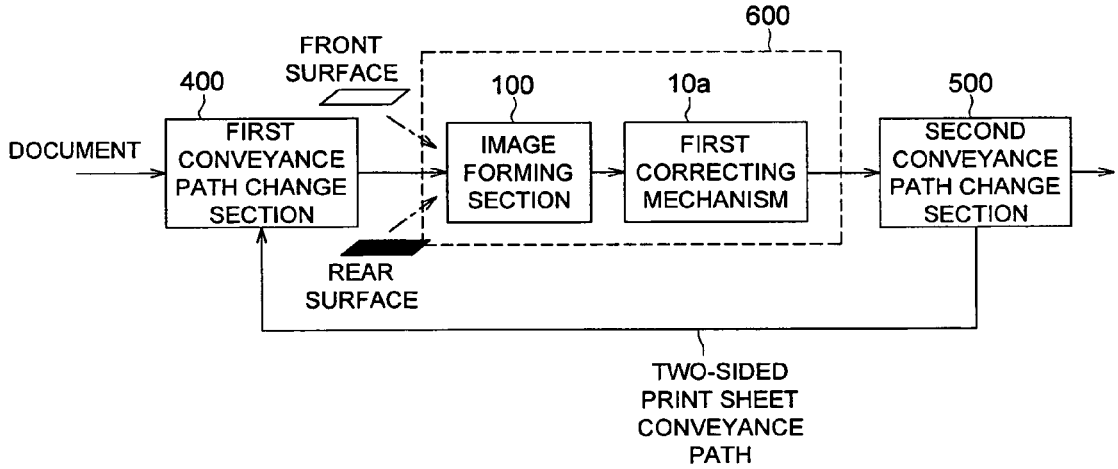

Referring to FIG. 1, the following describes the embodiment of the present invention. FIG. 1 is a diagram representing the functional structure of the image forming apparatus as a whole. FIG. 2 is a diagram representing the layout of the mechanism of the sheet material conveying section as an embodiment of the present invention. The image forming apparatus of the present invention includes at least an image forming section 100 and a sheet material conveying section 200. In a broader sense, it also includes a finishing section 300 in many cases. FIG. 3 is a functional structure of the first embodiment of the sheet material conveying section 200 as a first embodiment of the present invention. FIGS. 4(A) through (D) are the diagrams showing the operation timing of the sheet material conveying section 200 of FIG. 3. FIG. 5 is a functional structure of the second embodiment of the sheet material conveying section 200 as a second embodiment of the present invention. FIG. 6 is a variation of FIG. 5. FIGS. 7(A) through (D) are the diagrams showing the operation timing of the sheet material conveying section 200 of FIG. 5. FIGS. 8(A) and (B) are the diagrams showing the applied example of the embodiment of FIG. 3.

The following describes the schematic arrangement of the embodiment of the image forming apparatus with reference to FIG. 1. FIG. 1 shows an overall structure. The image forming section 100 receives a document and forms an image on a sheet material, for example, a printing sheet. After the image has been fixed by the fixing section, the sheet material is outputted to the sheet material conveying section 200. The sheet material conveying section 200 corrects the curl of the transfer sheet whose end has been bent (curled) by the fixing operation on the fixing section (the printing sheet with an image formed thereon, outputted from the fixing section will hereinafter be referred to as "transfer sheet"). The sheet is then fed to the finishing section 300. The finishing section 300 binds the transfer sheets to a desired form or ties them in a bundle, and outputs them.

In this case, the transfer sheet is generally conveyed from the image forming section 100 to the sheet material conveying section 200 along the conveyance path at a predetermined conveying speed. When the transfer sheet is fed to the finishing section 300 from the sheet material conveying section 200 along the conveyance path, it is preferably fed at a speed higher than the aforementioned specified speed because a higher efficiency is ensured when there is a large amount of printing work to be handled. The following describes the embodiment that allows the conveying speed to be increased while correcting the curl.

The following describes the case where one curl correcting mechanism is used (the first embodiment) and the case where two curl correcting mechanisms are used (the second embodiment). Before that, the mechanism common to both embodiments such as the curl correcting mechanism will be described first.

(A) Mechanism and related components: Description of the mechanism of each of the sheet material conveying section and curl correcting mechanism.

This will be described with reference to FIG. 2, where two curl correcting mechanisms are utilized. The case of two curl correcting mechanisms will be described first, and the case of one curl correcting mechanisms will be described thereafter.

(B) First embodiment: One curl correcting mechanism.

The function structure diagram of FIG. 3 and timing chart of FIGS. 4(A) through (D) will be used for description.

(C) Second embodiment: Two curl correcting mechanism.

The function structure diagram of FIG. 5 and timing chart of FIGS. 7(A) through (D) will be used for description. The variation of the example will be described with reference to FIG. 6.

(D) Application example:

FIGS. 8(A) and (B) will be used for explanation.

(A: Mechanism of Each of the Sheet Material Conveying Section and Curl Correcting Mechanism) (A1: Example of Using Two Curl Correcting Mechanisms)

Referring to FIG. 2, the following describes the mechanism of the sheet material conveying section 200. FIG. 2 shows the case where both the first curl correcting mechanism 10*a* and the second curl correcting mechanism 10*b* are provided.

In FIG. 2, the transfer sheet (printing sheet) fed from the image forming section 100 is fed through the first conveyance path 20 at the predetermined speed (hereinafter referred to as "initial speed vs") by the first conveyance mechanism 50. This initial speed vs is the same as the speed at which it is conveyed by the image forming section 100 (fixing device). The first conveyance mechanism 50, second conveyance mechanism 60, and third conveyance mechanism 70 are constituted by a pair of rotating rollers, respectively, which are driven by a motor. The transfer sheet is interposed and is fed to the next conveyance path.

The first curl correcting mechanism 10*a*is constituted by: a belt 3*a*(endless belt); a conveying roller 1*a* (indicating the conveyance mechanism or belt conveying mechanism using the belt 3*a*and conveying roller 1*a*, as described in claims) composed of a pair of rotating rollers for rotating the belt; and a pressing roller 4*a*which moves in the direction of engagement with the belt 3*a*to press one of the surfaces of the transfer sheet to be held in-between with the aid of the belt 3*a*and to squeeze the transfer sheet, wherein this pressing roller 4*a*rotates. To convey the transfer sheet, either the pressing roller 4*a*or conveying roller 1*a*is driven by a motor (not illustrated). Then the other is also rotated. The explanation in this case assumes that the pressing roller 4*a*is driven and rotated. The pressure for pressing the transfer sheet can be adjusted by moving the pressing roller 4*a*to the side of the conveying roller 1*a*. Further, the conveying speed can be adjusted by changing the speed of the motor for driving the pressing roller 4*a*.

The second conveyance mechanism 60 conveys the transfer sheet from the first curl correcting mechanism 10*a*to the second curl correcting mechanism 10*b* through the second conveyance path 30.

The second curl correcting mechanism 10*b* can be designed to have the same structure as that of the first curl correcting mechanism 10*a*. The same numbers indicate the same function, although there is a difference between "a" and "b"; provided, however, that the second curl correcting mechanism 10*b* is located opposite to the first curl correcting mechanism 10*a*with the second conveyance path located in-between (they are located on the right and left opposite to each other). Namely, the first curl correcting mechanism 10*a* is arranged in such a way that the surface of the transfer sheet is pressed by the pressing roller 4*a*against the side engaged with the belt 3*b*; whereas the second curl correcting mechanism 10*b* is arranged in such a way that the rear surface of the transfer sheet is pressed in the direction of engagement with the belt 3*b* by the pressing roller 4*b*. It should be noted that the pressure and conveying speed can be changed as in the case of the pressing roller 4*b* and pressing roller 4*a*.

When the direction of the transfer sheet surface cannot be changed between the first curl correcting mechanism 10*a* and second curl correcting mechanism 10*b*, namely, along the second conveyance path 30, the first curl correcting mechanism 10*a*and second curl correcting mechanism 10*b* may be arranged on the same side of the second conveyance path 30.

The third conveyance mechanism 70 ensures that the transfer sheet having been outputted from the second curl correcting mechanism 10*b* to the third conveyance path 40 is conveyed from the outlet to the finishing section 300 and is outputted.

In the example wherein the first curl correcting mechanism 10*a*and the second curl correcting mechanism 10*b* are operated simultaneously, the conveying speed is changed from the initial speed vs to the medium speed vm (vm>vs) in the first curl correcting mechanism 10*a*while it is holding (or applying pressure to) the transfer sheet. In the second the curl correcting mechanism 10*b*, the conveying speed is from the medium speed vm to the target speed vo (vo>vm) while it is holding the transfer sheet, (wherein target speed can be defined as the speed at which the finishing section 300, for example, receives the transfer sheet). The target speed vo is set in two phases. The timing of arrival is detected by the timing detection section 6 of FIG. 2. Then the conveying speed is changed according to the timing signal created on the basis of the aforementioned detected timing, with due consideration given to the conveyance time for the sheet to be conveyed along the first conveyance path, the conveyance time for the sheet to be conveyed by the first curl correcting mechanism 10*a*, and the conveyance time for the sheet to be conveyed by the second curl correcting mechanism 10*b*.

In this case, however, the pressure when the transfer sheet is interposing by the first curl correcting mechanism 10*a*and the second curl correcting mechanism 10*b* is constant for the time. Further, the first curl correcting mechanism 10*a*reverses the curl of the transfer sheet having been conveyed. The transfer sheet provided with reversed curl is fed to the second curl correcting mechanism 10*b*, and the second curl correcting mechanism 10*b* finally corrects the curl (reversed curl) of the transfer sheet. (Details will be described later with reference to the second embodiment).

(A2: Example of Using Only One Curl Correcting Mechanism)

This is the case where only the first curl correcting mechanism 10*a*is enabled (wherein the second the curl correcting mechanism 10*b* is disabled). In this case, only one curl correcting mechanism is available, so only the first curl correcting mechanism 10*a*of FIG. 2 is operated. It corresponds to the case where the second curl correcting mechanism 10*b* is not provided, or the case where the second curl correcting mechanism 10*b* is not used even if the second curl correcting mechanism 10*b* is provided. When the first curl correcting mechanism 10*a*is operating independently, there is no difference from the case where it operates together with the second curl correcting mechanism 10*b*. However, there is a difference in the conveying speed and pressure when the transfer sheet is interposed.

To be more specific, the conveying speed is changed from the initial speed vs to the target speed vo (vo>vs) (set to vo in one step) in such a way that the pressure is also increased in proportion. The timing of the arrival is detected by the timing detection section 6 of FIG. 2, and the timing of changing the speed is determined according to the timing signal on the basis of the aforementioned timing, with due consideration given to the conveyance time for the sheet to be conveyed along the first conveyance path. (Details will be described later with reference to the first embodiment).

(A3: Variation of the Curl Correcting Mechanism)

Each of the curl correcting mechanisms of FIG. 2 can be designed in such a way that the conveying rollers 1*a*and 1*b* are driven by a motor for the conveyance of the sheet. In this case, the pressing rollers 4*a*and 4*b* can be designed in such a way that the pressure is changed in conformity to the amount of rotation, using an eccentricity cam. Further, the first curl correcting mechanism 10*a* and the second curl correcting mechanism 10*b* are not required to be identically the same with each other. A variation may be used.

In FIG. 2, belts 3*a*and 3*b* are used on one side to sandwich the sheet. This is intended to provide elasticity to convey the transfer sheet by pressing it with metallic pressing rollers 4*a*and 4*b*. To be more specific, the elasticity is provided by the tension of the belts 3*a*and 3*b* applied between a pair of metallic rotating rollers constituting the conveying rollers 1*a*and 1*b*.

Such being the case, the following arrangement can also be adopted. Each of the conveying rollers 1*a*and 1*b* is constituted by one (or two) rotating roller(s). The circumferential portion of the rotating roller interposing the transfer sheet is made of an elastic member such as a sponge. The metallic pressing rollers 4*a*and 4*b* holding the transfer sheet in-between are pressed toward the elastic member, which is then conveyed (not illustrated).

(B: First Embodiment: Only One Curl Correcting Mechanism of FIG. 2 is Used)

The following describes the case wherein, based on the functional structure of FIG. 3 and the timing chart of FIGS. 4(A) through 4(D), only one curl correcting mechanism, that is, the first curl correcting mechanism 10*a*of FIG. 2 is used to correct the curl, and the conveying speed is increased.

When the timing detection section 6 of FIG. 3 is located at the inlet wherein the transfer sheet is conveyed to the first curl correcting mechanism 10*a*, it generates the timing signal for the timing having been detected or the timing slightly delayed, and sends it to the controller 7*a*. In this case, however, when the timing detection section 6 is located at the forward inlet beyond the first conveyance path 20 as shown in FIG. 2, the time for conveying along the first conveyance path is calculated in advance, based on the conveying speed at the inlet (or is stored in the memory section). The arrival timing is detected at the inlet. The timing detection section 6 generates the timing signal indicating the time elapsed for conveyance along the first conveyance path from the time of arrival (wherein the controller 7*a*can be used to generate this timing signal). This timing signal is then sent to the controller 7*a*. Refer to the timing signal of FIG. 4(A). As shown in FIG. 4(A), the timing can be time t1 when the sheet enters the first curl correcting mechanism, or time t2 which is slightly delayed.

The speed control section 71*a*stores in advance the conveying speed of the transfer sheet when it passes through the first conveyance path from the image forming section 100 (this speed may be determined by the image forming section 100; hereinafter referred to as "initial speed vs"); and the conveying speed for conveying the sheet to the finishing section 300 through the second conveyance path 30 and the third conveyance path 40 (this speed may be determined by the finishing section 300; hereinafter referred to as "target speed vo"). For example, the timing signal is received at time t2. Then the timing and the amount of control for increasing the conveying speed from the initial speed vs to the target speed vo upon receipt of this signal are sent to the conveyance and drive section 2*a*. The conveyance and drive section 2*a*is made of a motor for driving the pressing roller 4*a*, for example. It increases the rotation speed by the amount of control specified at time t2. As a result, the pressing roller 4*a*conveys the transfer sheet at the target speed vo. Based on the information of the relationship between the rotation speed and conveying speed (so-called linear speed in contrast to the rotation speed), the speed control section 71*a*obtains the amount of control by computation (the amount of control equivalent to vo−vs). FIG. 4(B) shows the timing for the conveying speed. The speed is changed at least during the time when the first curl correcting mechanism 10*a*holds the transfer sheet (from t1 through t2 in FIG. 4(A)), subsequent to startup of holding the transfer sheet in-between.

As indicated by FIG. 4(D), the pressure control section 72*a*sends the instruction for movement by a predetermined distance. (a predetermined amount of rotation in the case of an eccentric cam) to the pressing and driving section 5*a*at time t2. The pressing roller 4*a*is moved by the specified amount of distance, thereby increasing the pressure applied to the transfer sheet. The pressing and driving section 5*a* is provided with a moving mechanism in the present example. The pressure control section 72*a*stores the value obtained empirically in advance as the specified predetermined amount of movement. The time when the pressure is changed by the pressure control section 72*a*is the same as the time when the speed is changed by the speed control section 71*a*. The time when the pressure is changed is described as the same as the time when the speed is changed. However, the time of applying the pressure and the pressure can be changed as required, based on the value empirically given in advance.

The conveying speed of the transfer sheet in FIG. 4(B) is transferred to the second conveyance mechanism 60 after the time t3 for terminating the holding of the transfer sheet in-between. The sheet is fed at the target speed vo. After time t3, the belt speed of FIG. 4(C) and the pressure of FIG. 4(D) are returned to the levels before time t2. Then the system waits for the arrival of the next transfer sheet. The time t3 can be detected by a detecting device. It can also be generated by the timing detection section 6 or the controller 7*a*, based on the timing of arrival detected by the timing detection section 6. This does not require high precision. It is sufficient only if the aforementioned belt speed and pressure come back to the original levels at least before the arrival of the next transfer sheet.

(C: Second Embodiment: Example of Using Both of the Curl Correcting Mechanisms in FIG. 2)

The following describes the art of using two curl correcting mechanisms to correct the curl based on the functional structure of FIG. 5 and the timing chart of FIG. 7, and increasing the conveying speed. The first curl correcting mechanism 10*a*of FIG. 5 is the same as that of FIG. 3. The second curl correcting mechanism 10*b* also have the same functions as those of the first curl correcting mechanism 10*a*, for the blocks having the same reference numerals, although the letters of the references are different. However, differences are found in conveying speed and pressure in both cases.

One timing detection section 6 of FIG, 5 is located at the inlet through which the transfer sheet enters the first curl correcting mechanism 10*a* (See FIG. 2). Two types of timing signal having been detected are generated. One of them is a timing signal to be sent to the controller 7*a*. In this case, similarly to the case of the first embodiment, the timing detection section 6 detects the timing signal for the time of arrival. The timing detection section 6 supplies the controller 7*a*with the timing signal indicating the time elapsed for conveyance along the first conveyance path, based on that timing (e.g. time t2 of FIG. 7(A)). This conveyance time can be obtained by calculation or can be stored in advance. The other type is a timing signal to be sent to the controller 7*b*. In this case, the timing detection section 6 generates a timing signal which is delayed by the time calculated by the addition of the time for conveyance along the first conveyance path 20, the time for conveyance by the first curl correcting mechanism 10*a* and the conveyance time for conveyance along the second conveyance path (e.g. time t5 of FIG. 7(A)). In this case, as will be described later, the transfer sheet is conveyed along the first conveyance path 20 at the initial speed vs and along the second conveyance path 30 at the medium speed vm (vo>vm>vs). The sheet is further conveyed through the first curl correcting mechanism 10*a* at both the initial speed vs and the medium speed vm. Thus, each conveyance time is obtained in advance from the conveying speed and the length of each conveyance path. It is also possible to store the conveyance time measured in advance.

The speed control section 71*a*stores in advance the initial speed vs an the medium speed vm of the transfer sheet passing through the first conveyance path 20 from the image forming apparatus 100. Interposing of the transfer sheet starts at time t1. After that, the timing signal is received at time t2. Upon receipt of this timing signal, the timing and the amount of control (the amount of control corresponding to vm−vs) for increasing the conveying speed from the initial speed vs to the medium speed vm are sent to the conveyance and drive section 2*a*. The conveyance and drive section 2*a*provides control by the amount of control specified at time t2, and increases the rotation speed of the pressing roller 4*a*. As a result, the pressing roller 4*a* conveys the transfer sheet at the medium speed vm (See FIG. 7(B)). It should be noted that speed change by the speed control section 71*a*is carried out at least while the transfer sheet is interposed by the first curl correcting mechanism 10*a*(from t1 through t3 in FIG. 7(B)).

The speed control section 71*b* stores in advance the medium speed vm and target speed vo of the transfer sheet conveyed along the second conveyance path 30. Interposing of the transfer sheet starts at time t4. After that, the timing signal is received at time t5. Upon receipt of this timing signal, the timing and the amount of control (the amount of control corresponding to vm−vs) for increasing the conveying speed from the medium speed vm to the target speed vo are sent to the conveyance and drive section 2*b*. The conveyance and drive section 2*b* provides control by the amount of control specified at time t5, and increases the rotation speed of the pressing roller 4*b*. As a result, the pressing roller 4*b* conveys the transfer sheet at the target speed vo (See FIG. 7(B)). It should be noted that speed change by the speed control section 71*b* is carried out at least while the transfer sheet is interposed by the second curl correcting mechanism 10*b* (from t4 through t6 in FIG. 7 (B)).

In terms of numerical values, the conveying speeds can be given as the initial speed vs=100 mm/s (linear speed), the medium speed vm=300 mm/s (linear speed) and target speed vo=900 mm/s (linear speed), for example. The first speed described in claims corresponds to the initial speed vs (or the medium speed vm), and the second speed described in claims corresponds to either the medium speed vm or target speed vo.

Each of the pressure control sections 72*a*and 72*b* controls the pressing and driving sections 5*a*and 5*b* in such a way that a predetermined pressure is applied with reference to time, independently of the timing (FIG. 7(D)). The pressing roller 4*a*and pressing roller 4*b* apply pressure to the surfaces of the transfer sheet opposite to each other, thereby correcting the curl through mutual cooperation. Further, the pressure control sections 72*a*and 72*b* control the pressing roller drive section 5*a*in such a way the first curl correcting mechanism 10*a*will apply pressure so as to provide a curl reverse to that of the transfer sheet having reached. Further, each of the pressure control sections 72*a* and 72*b* controls the pressing and driving section 5*b* to ensure that the reversed curl of the transfer sheet is finally corrected by the second curl correcting mechanism 10*b* (FIG. 5). These pressures are determined empirically with respect to the speed.

As described above with reference to the conventional art, if the conveying speed is high, the curl of the trailing edge in the direction of conveyance of the transfer sheet tends to remain without being corrected. To solve this problem, the following measures are taken. The conveying speed of the second curl correcting mechanism 10*b* is higher than that of the first curl correcting mechanism 10*a*. Accordingly, the pressure of the first curl correcting mechanism 10*a*is adjusted to ensure that the curl of the leading edge of the transfer sheet reaching the second curl correcting mechanism 10*b* will be strong, and the curl of the trailing edge will be weak, as shown in the enlarged view of FIG. 5. The second curl correcting mechanism 10*b* is adjusted to the pressure for correcting the curl of the leading edge of the transfer sheet to be conveyed. For this purpose, the pressure control section 72*a*may allow a slight change of the pressure of the pressing roller 4*a*.

The transfer sheet conveyance speed of FIG. 7(B) is transferred to the second conveyance mechanism 60 after the time t3 when the first curl correcting mechanism 10*a* terminates interposing of the transfer sheet. The sheet is fed at the medium speed vm. Further, the transfer sheet conveyance speed is transferred to the third conveyance mechanism 70 after the time t6 when the second curl correcting mechanism 10*b* terminates interposing of the transfer sheet. The sheet is fed at the target speed vo. However, as shown in FIG. 7(C), after time t3, the speed of the belt 3*a*is returned to the level before time t2. Then the system waits for the arrival of the next transfer sheet. Similarly, after time t6, the speed of the belt 3*b* is returned to the level before time t5. Then the system waits for the arrival of the next transfer sheet. Times t3 and t6 can be detected by a detecting device, or can be generated by the timing detection section 6 or the controllers 7*a*and 7*b*, based on the timing of arrival detected by the timing detection section 6*a*.

(C1: Variation of FIG. 5)

FIG. 6 shows a variation of the method of providing timing shown in FIG. 5. The difference between FIG. 6 and FIG. 5 is that, in FIG. 6, the timing detection section 6*a* and the timing detection section 6*b* are installed at the portion of the first curl correcting mechanism 10*a*and the second curl correcting mechanism 10*b* where the transfer sheet enters. Accordingly, in each of the curl correcting mechanisms 10*a*and 10*b*, the timing of changing the conveying speed can be set to the timing detected by the timing detection section 6*a*and the timing detection section 6*b*, or to the timing delayed as desired. To be more specific, there is no conveyance path between the timing detection sections 6*a*and 6*b*, and the curl correcting mechanisms 10*a*and 10*b*. This eliminates the need for the timing signal to incorporate the conveyance time along the conveyance path.

(D: Example of Using the First Embodiment)

FIGS. 8(A) and 8(B) show the examples of using the invention of FIG. 3 for two-sided printing on the transfer sheet. In FIG. 8(A), the first curl correcting mechanism 10*a* is utilized. Two mechanisms having the same structure as that of FIG. 3 are employed. It should be noted, however, that at least either the conveying speed or pressure require adjustment. The following describes the procedure of two-sided printing operations.

(1) When the document has arrived, the first conveyance path change section 400 sends the document to the image forming section 100, and an image is formed on one of the surfaces of the transfer sheet (front surface).

(2) The second conveyance path change section 500 feeds the transfer sheet coming from the image forming section 100, to the first curl correcting mechanism 10*a*located on the side of the returning route 700 (returning conveyance path), according to the instruction of two-sided printing, wherein the sheet is uncurled. It should be noted that, unlike the case of FIG. 3 (the first embodiment), the conveying speed of the first curl correcting mechanism 10*a*located on the side of the aforementioned returning route 700 (returning conveyance path) is adjusted in conformity to the conveying speed outputted by the image forming section 100 and the conveying speed for receiving the sheet. The pressure is also adjusted in conformity to the conveying speed. Similarly to the case of the first curl correcting mechanism 10*a* having been described so far, the timing for applying pressure and the pressure can be adjusted as appropriate, according to the value having been obtained empirically.

(3) In response to the instruction of two-sided printing, the first conveyance path change section 400 reverses the surface of the transfer sheet having received from the first curl correcting mechanism 10*a*, and sends it to the image forming section 100, whereby an image is formed on the rear surface.

(4) The second conveyance path change section 50 receives the transfer sheet on the rear surface of which an image has already been formed by the image forming section 100, and sends it to the first curl correcting mechanism 10*a* located on the side of the main route 600, wherein the sheet is uncurled and outputted. The conveying speed and pressure of the first curl correcting mechanism 10*a* in this case are changed according to the procedure described with reference to FIG. 3 (the first embodiment).

In the example shown in FIG. 8(B), one first curl correcting mechanism 10*a*is located on the side of the main route 600, and also serves the function of the first curl correcting mechanism 10*a*located on the returning route given in FIG. 8(A). The first curl correcting mechanism 10*a* differs in the conveying speed and pressure according to whether the transfer sheet is outputted to the two-sided print sheet conveyance path (returning conveyance path), or it is ejected to the finishing section 300. Control must be provided on a time division basis as shown in the aforementioned (2) in the former case, and as shown in the aforementioned (4) in the latter case.

The second conveyance path change section 500 may be included in the composition of the main route 600 and returning route 700 shown in FIGS. 8(A) and 8(B). This composition, however, is practically the same as that of the image forming apparatus as shown in FIG. 3 and FIG. 1.

According to the aforementioned application examples, an image is formed on the rear surface after the curl produced subsequent to fixing of the image on the surface has been corrected. This arrangement minimizes deviations in dimensions caused by curling.

The controllers 7*a*and 7*b* in each of the aforementioned embodiments can be constructed of a CPU and a memory storing the program for allowing the CPU to execute the aforementioned processing functions.

The present embodiment increases the sheet material conveying speed and the pressure to the sheet material for uncurling, during the correction by a curl correcting mechanism. This arrangement corrects the curl of the sheet material and improves the productivity (conveying speed) at the same time.

In the two-sided printing mode wherein the sheet material having an image formed on one of the surfaces thereof is sent back to the image forming section and an image is then formed on the other surface, the curl is first corrected by a correcting mechanism along the returning conveyance path, and an image is then formed on the other surface. This structure reduces the image deviation resulting from curling at the time of image formation on the other surface.

What is claimed is:

1. An image forming apparatus comprising:

(a) an image forming section which forms an image on a sheet material;

(b) a first curl correcting mechanism which holds and conveys the sheet material on which the image has been formed by the image forming section, the first curl correcting mechanism comprising, (1) a first conveying mechanism which elastically conveys the sheet material, (2) a first roller member which holds the sheet material with the conveying mechanism therebetween to apply pressure to one surface of the sheet material being conveyed, (3) a first conveyance and drive section having a first motor which drives the first conveying mechanism or the first roller member to convey the sheet material, and (4) a flirst pressing and driving section which relatively moves the first roller member or the first conveying mechanism toward each other, wherein pressure applied to the one surface of the sheet material during a holding operation can be changed by changing a distance between the first roller member and the first conveying mechanism through the first pressing and driving section and a conveying speed of the sheet material can be changed by changing a rotation speed of the motor through the first conveyance and drive section; and (c) a controller which controls the first curl correcting mechanism to change the conveying speed from a speed vs to a speed vm higher than the speed vs (vm>vs) while the sheet material is held, and to change the pressure to a high pressure in response to a change of the conveying speed while the sheet material is held, whereby a curl of the sheet material is reduced.

2. The image forming apparatus of claim 1, further comprising:

a timing detection section which detects a timing when the sheet material with an image formed thereon is held by the first curl correcting mechanism, and outputs a timing signal to change the conveying speed, wherein the controller which controls the first curl correcting mechanism changes the conveying speed and the pressure when the timing signal is received.

3. The image forming apparatus of claim 1, wherein the first conveying mechanism further comprises a rotating roller having an elastic portion to come into contact with the first roller member, and the conveying speed of the sheet material can be changed by driving the rotating roller or the first roller member to rotate.

4. The image forming apparatus of claim 1, wherein the first conveying mechanism is a belt conveyance mechanism comprising a belt and a pair of rotating rollers rotatably holding the belt, wherein the first roller member applies pressure to one surface of the sheet material being conveyed, so as to be in contact with the belt of the belt conveyance mechanism, and pressure of the first roller member can be changed.

5. The image forming apparatus of claim 1, further comprising:

(d) a second curl correcting mechanism, provided downstream of the first curl correcting mechanism, which holds and conveys the sheet material, the second curl correcting mechanism comprising:

(1) a second conveying mechanism which elastically conveys the sheet material, (2) a second roller member which holds the sheet material with the second conveying mechanism therebetween to apply pressure to one surface of the sheet material being conveyed, (3) a second conveyance and drive section having a second motor which drives the second conveying mechanism or the second roller member to convey the sheet material, and (4) a second pressing and driving section which relatively moves the second roller member or the second conveying mechanism toward each other, wherein pressure applied to one surface of the sheet material during a holding operation can be changed by changing a distance between the second roller member and the second conveying mechanism through the second pressing and driving section and a conveying speed of the sheet material can be changed by changing a rotation speed of the second motor through the second conveyance and drive section; and wherein pressure is applied to the other surface opposite to the one surface of the sheet material, and the second conveying speed thereof can be changed, wherein the second curl correcting mechanism changes the conveying speed from the speed vm to a speed vo higher than the speed vm (vo>vm) while the sheet material is pressed, whereby a curl of the sheet material is reduced.

6. The image forming apparatus of claim 5, wherein:

the second curl correcting mechanism receives the sheet material outputted from the first curl correcting mechanism, the conveying speed of the sheet material can be changed by driving the second conveying mechanism or the second roller member, and the image forming apparatus further comprising;

a timing detection section which outputs a second timing signal showing a timing when the sheet material with an image formed thereon is held by the second conveying mechanism and the second roller member, and a second speed control section which, upon receipt of the second timing signal, controls the second curl correcting mechanism to change the conveying speed from the speed vm to the speed vo higher than the speed vm (vo>vm).

7. The image forming apparatus of claim 1, further comprising:

a returning conveyance path through which the sheet material with an image formed on one surface thereof by the image forming section is reversed, and is conveyed back to the image forming section so as to be printed on an opposite surface thereof, wherein the first curl correcting mechanism on a returning side, provided on the returning conveyance path, holds and rotates the sheet material having an image formed on the one surface, and conveys by applying a predetermined interposing pressure, and wherein the second curl correcting mechanism, upon receipt of the sheet material with images formed on both surfaces by the image forming section, holds, rotates and conveys the sheet material.

8. A sheet material conveying device comprising:

(a) a curl correcting mechanism comprising:

(1) a conveying mechanism which elastically conveys a sheet material with an image formed thereon, (2) a roller member which holds the sheet material with conveying mechanism therebetween to apply pressure to one surface of the sheet material conveyed at a first speed, (3) a conveyance and drive section having a motor which drives the conveying mechanism or the roller member to convey the sheet material, and (4) a pressing and driving section which relatively moves the roller member or the conveying mechanism toward each other, wherein pressure applied to one surface of the sheet material which is conveyed at the first speed during a holding operation can be changed by changing a distance between the roller member and the conveying mechanism through the pressing and driving section, and a conveying speed of the sheet material can be changed by changing a rotation speed of the motor through the conveyance and drive section; and (b) a controller which controls the curl correcting mechanism to change the conveying speed from the first speed to a second speed faster than the first speed while the sheet material is held, and to change the pressure of the roller member to stronger pressure to convey the sheet material in response to a change of the conveying speed while the sheet material is held.

9. The sheet material conveying device of claim 8, wherein the conveying mechanism comprises a rotating roller having an elastic member at a circumferential portion thereof, the roller member holds the sheet material with the conveying mechanism therebetween to apply pressure to one surface of the sheet material being conveyed, and pressure of the roller member can be changed.

* * * * *

UNITED STATES PATENT AND TRADEMARK OFFICE

CERTIFICATE OF CORRECTION

PATENT NO. : 7,654,519 B2
APPLICATION NO. : 11/474290
DATED : February 2, 2010
INVENTOR(S) : Yamane et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 402 days.

Signed and Sealed this

Twenty-eighth Day of December, 2010

David J. Kappos

David J. Kappos
*Director of the United States Patent and Trademark Office*